United States Patent [19]

Denis et al.

[11] 3,959,982

[45] June 1, 1976

[54] REFRIGERATION UNIT

[76] Inventors: Joseph Herbert Denis, 75 Lawrence Ave., Inwood, N.Y. 11696; Abraham J. Rodolitz, 40 Neptune Ave., Woodmere, N.Y. 11598

[22] Filed: Nov. 1, 1974

[21] Appl. No.: 519,931

[52] U.S. Cl. ..... 62/223; 62/371; 62/457; 62/512; 62/514 R; 236/92 B

[51] Int. Cl.[2] ..... F25B 41/04

[58] Field of Search ..... 62/149, 174, 227, 503, 62/509, 512, 514, 222, 223, 224, 371, 457; 236/92 B

[56] References Cited

UNITED STATES PATENTS

| | | | |
|---|---|---|---|
| 2,156,426 | 5/1939 | Brown et al. | 62/512 X |
| 2,214,298 | 9/1940 | Gilbert, Sr. | 62/224 |
| 2,791,101 | 5/1957 | Zearfoss, Jr. | 62/512 X |
| 2,912,833 | 11/1959 | McGrath | 62/498 X |
| 3,257,820 | 6/1966 | Case et al. | 62/223 |
| 3,633,381 | 1/1972 | Haaf et al. | 62/222 |

*Primary Examiner*—William F. O'Dea
*Assistant Examiner*—Ronald C. Capossela

[57] ABSTRACT

A refrigeration unit, particularly adapted for portable refrigerator chests, includes a primary evaporation coil whose inlet end is connected via a capillary tube to a source of pressurized liquid refrigerant. A substantially closed refrigeration receptable in fluid communication with the outlet side of the primary evaporator, receives the refrigerant, which may not have completely evaporated, and separates the phases by venting the evaporated gaseous phase to the atmosphere while directing the unevaporated liquid refrigerant into a second evaporator coil wherein it is completely evaporated. A thermostatically controlled valve regulates the flow of refrigerant to the primary evaporator as a function of the temperature within the chest.

8 Claims, 7 Drawing Figures

REFRIGERATION UNIT

BACKGROUND OF THE INVENTION

This invention relates generally to refrigeration apparatus and, more particularly, to a refrigeration unit for use in cooling the interior of a portable refrigerator chest.

Portable chests having refrigerated interior storage areas are useful in many applications such, for example, as in food containers, medical supply storage containers, etc. In the past, such a chest often merely included a thermally insulated ice (or "dry ice") containing box. These chests are subject to obvious disadvantages, including the weight and bulk of the ice, not to mention the need to periodically replenish the ice supply which melts (or vaporizes) over a period of time.

Relatively recently, attempts have been made to provide iceless portable refrigerator chests. Generally, these portable refrigerator units include single cycle refrigerant systems (i.e., no compressor is provided) wherein stored liquid refrigerant is directed through an evaporator positioned within the refrigerator compartment where the refrigerant evaporates and thus reduces the temperature within the container. Although these units are more desirable than the ice charged boxes, frequently, the liquid refrigerant fails to completely evaporate which reduces the efficienty of the device. Incomplete evaporation also creates a safety hazard, since excess liquid refrigerant might escape from the system and come into contact with the skin causing severe "freeze burns". Another disadvantage of both portable "iceless" and ice charged refrigerator chests is that the temperature within the chest has not been controllable to a suitable degree, but rather is dependent upon the quantity of ice or charge of refrigerant within the chest.

SUMMARY OF THE INVENTION

Accordingly, one object of the present invention is to provide a new and improved self-contained "iceless" refrigerator chest.

Another object of the present invention is to provide a portable refrigeration unit which is both efficient and safe.

Still another object of the present invention is to provide a new and improved portable "iceless" refrigeration unit whose interior temperature may be well-regulated.

Briefly, in accordance with the present invention, thses and other objects are attained by providing a primary evaporator within a refrigeration unit, such as a portable chest, connectable to a source of liquid refrigerant through a conduit having a pressure-reducing device, such as a capillary tube, interposed in it. After the refrigerant passes through the evaporator where it ideally changes to its gaseous phase, it enters a phase separation tank whereupon any refrigerant which remains in the liquid form, ie., which has not evaporated, is directed to a secondary evaporator also positioned within the refrigeration unit. The refrigerant which has evaporated in the primary evaporator is vented to the atmosphere from the phase separation tank. A thermostatically controlled valve is interposed in the conduit connecting the source of liquid refrigerant to the primary evaporator. This valve blocks the refrigerant flow to the primary evaporator whan the temperature within the unit descends below a predetermined temperature and opens when the temperature rises above the predetermined temperature.

DESCRIPTION OF THE PREFERRED EMBODIMENTS

Figure 1:
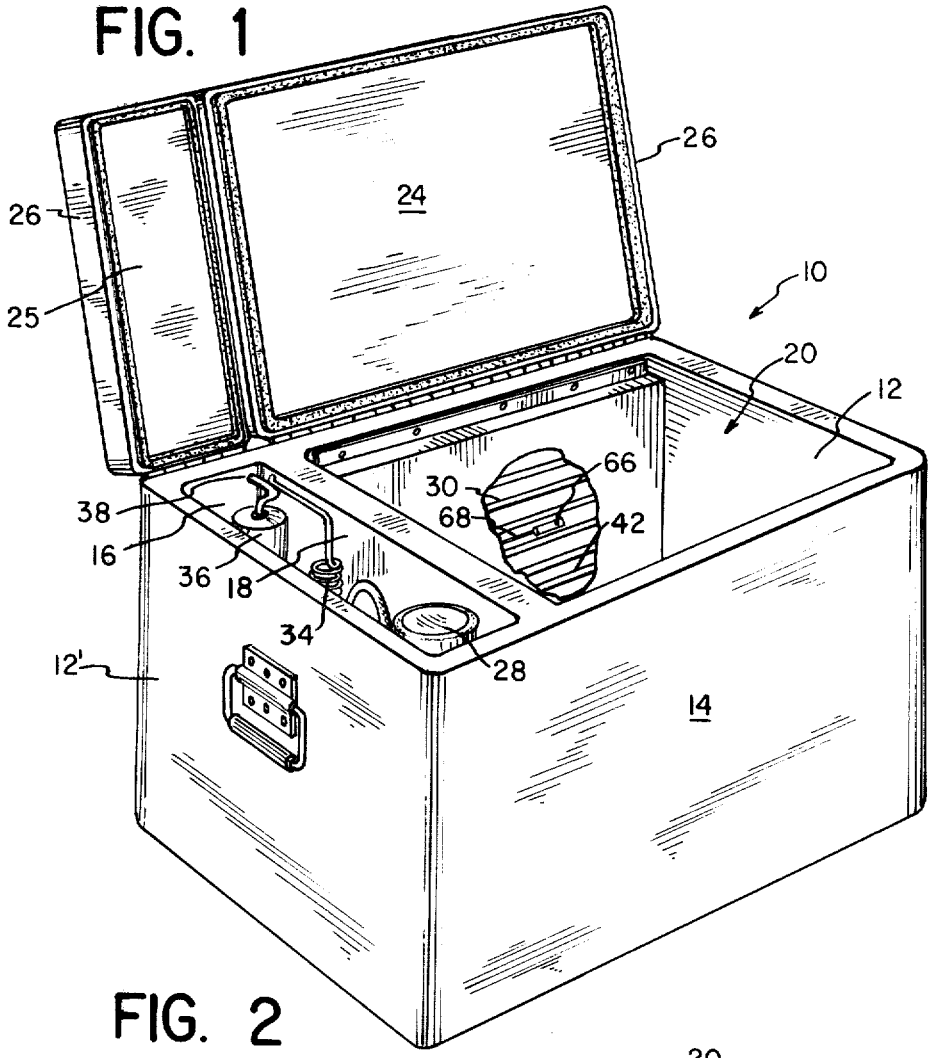
FIG. 1 is a perspective view of a portable refigeration unit including apparatus according to the present invention.
Figure 2:
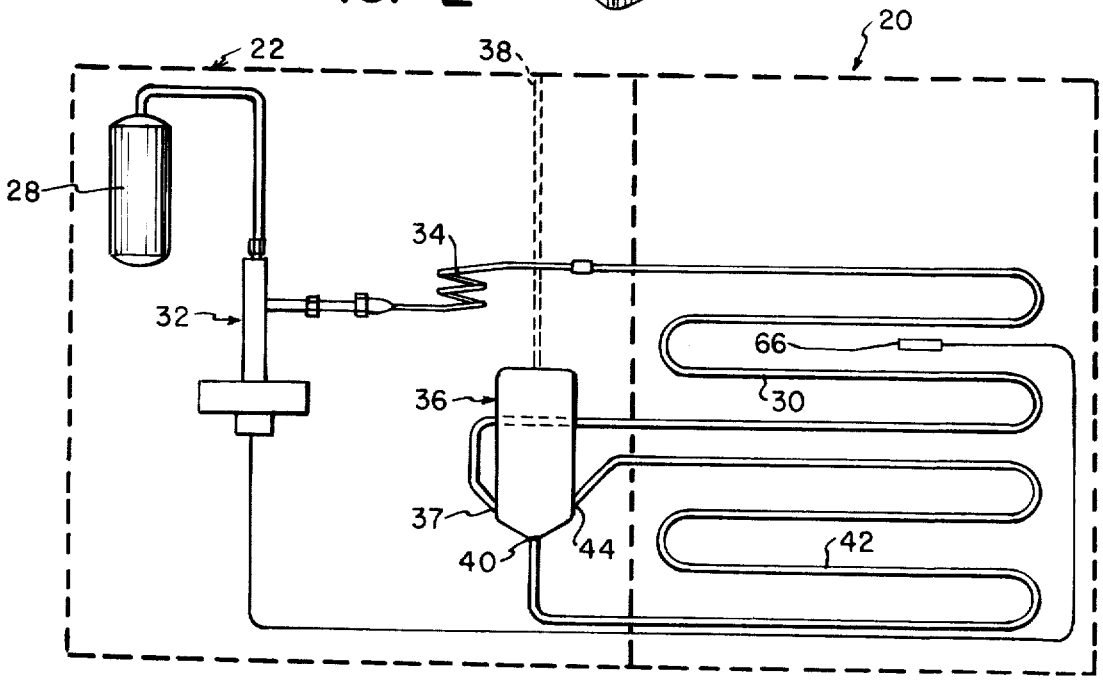
FIG. 2 is a schematic diagram of the refrigeration system according to the present invention.
Figure 3:
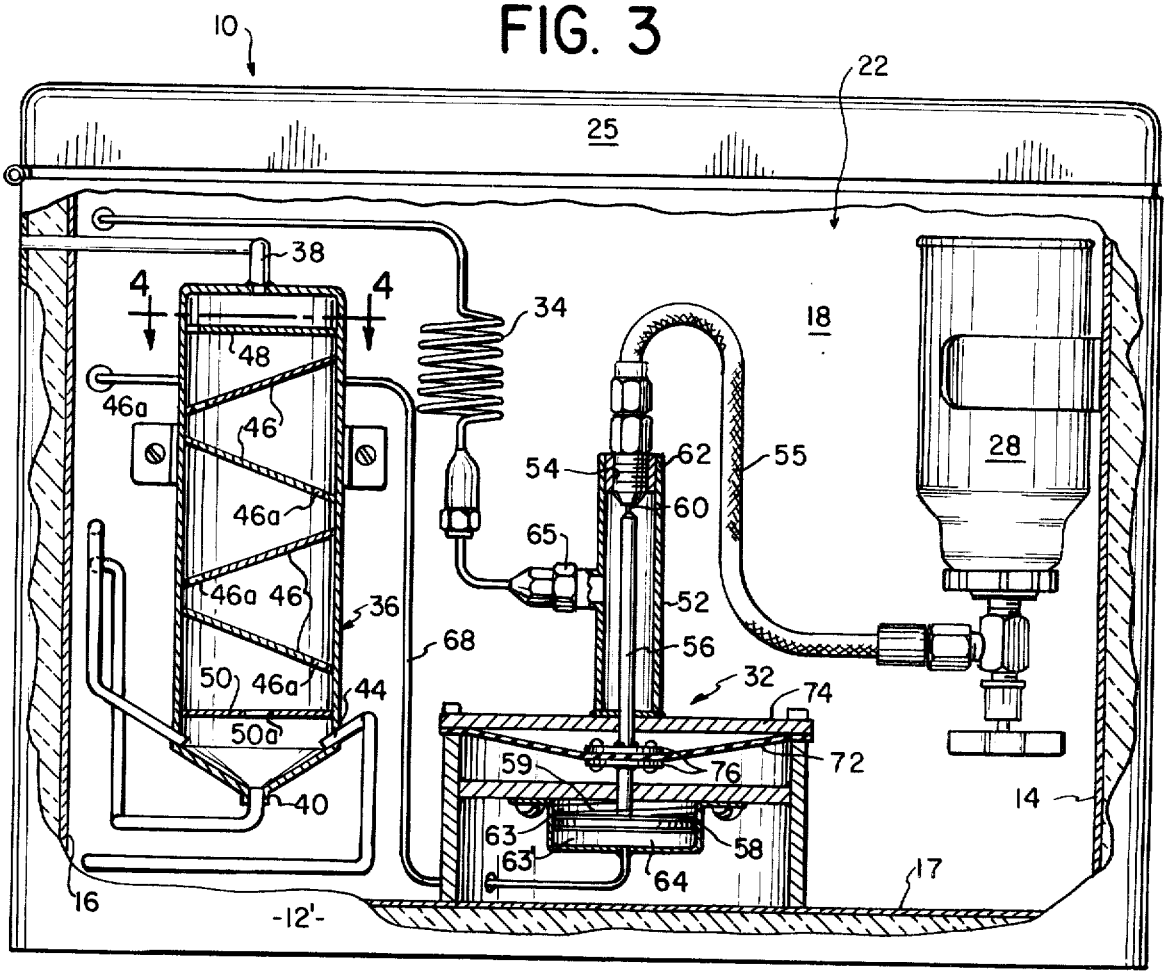
FIG. 3 is a broken-away side view of the refrigeration unit of FIG. 1 showing elements of the refrigeration system in section.

Referring now to the drawings wherein like reference characters designate like or corresponding parts throughout the several views and, more particularly, to FIGS. 1–3, a refrigerator chest generally denoted as 10 includes a pair of sidewalls 12, 12′, front and rear walls 14, 14′ and a bottom 17. A partition wall 18 divides the interior of refrigerator chest 10 into a refrigerator compartment 20 and a smaller, mechanism compartment 22. Suitable thermal insulation is provided over the inner surfaces of the walls and bottom defining the refrigerator compartment 20. A pair of doors 24, 25 are hinged to the upper edge of rear wall 14′ to selectively provide access to or seal the refrigerator compartment 20 and mechanism compartment 22 respectively. Rubber gaskets 26 line the perimeters of doors 24, 25 to provide complete thermal insulation when the doors are closed. As will be seen, insulated door 25 is normally maintained closed, sealing the mechanism compartment, being opened only when the refrigerant source is exhausted and must be replaced.

A schematic diagram of the refrigeration system of the present invention is shown in FIG. 2. A source of pressurized liquid refrigerant 28, such as a can of liquid Freon 12 (for example, Ucon Refrigerant 12 obtained from Union Carbide Corporation) is provided within mechanism compartment 22. Of course, other refrigerants may be used in lieu of Freon as is well known in the art. As will be described in greater detail below, the Freon is directed to a primary evaporator 30 through a flexible conduit 55 having a thermostatic control valve 32 and an expansion device, such as a capillary tube 34 interposed along its length. Although ideally all of the refrigerant evaporates within the primary evaporator, in practice some liquid refrigerant remains. Thus, after passing through the primary evaporator 30 the refrigerant in mixed phase is directed into a phase separation tank 36 whereupon the gaseous refrigerant is vented through port 38 to the atmosphere. The remaining liquid portion of the refrigerant accumulates temporarily within tank 36. Since the pressure within the tank is greater than that in the line "downstream" from it, the accumulated liquid refrigerant exits from tank 36 through outlet 40 and enters a secondary evaporator 42 where the remaining refrigerant is evaporated. Finally, the residual gaseous refrigerant exiting from secondary evaporator 42 re-enters tank 36 at a second inlet 44 and is vented to the atmosphere via port 38. Except for the primary and secondary evaporators 30, 42 which are preferably mounted on the rear wall within the refrigerator compartment 20, and the sensor for the thermostatic valve (described below), all other equipment referred to above is housed within mechanism compartment 22.

Refering to FIG. 3, the refrigerant tank may be held within compartment 22 by a spring clamp 51 fixed to the chest wall. A conventional valve fitting 53 is coupled to the tank and communicates with a flexible conduit 55 which directs the liquid refrigerant to the thermostatic control valve assembly 32. As shown in FIG. 3, control valve assembly 32 includes a sleeve 52 which is internally threaded at one end 54 to receive within its upper end a conventional check valve 62 which is attached to the end of flexible conduit 55. Valve 62, which can be identical to those used as air inlets for tire inner tubes, is normally closed and thus will not permit the flow of refrigerant through it. A pin 60 normally protrudes from check valve 62, which, when depressed or forced inwardly towards valve 62, opens the valve in a known manner. A rod 56 extends longitudinally within sleeve 52 so that its upper end is alinged and contiguous with the valve pin 60. The lower end of rod 56 extends out of sleeve 52 and is attached to a piston 58. Piston 58 is movably mounted within a cylinder chamber 64, its periphery sealingly engaging the inner surface of the chamber 64, dividing the same into an upper subchamber 63 and a lower subchamber 63'. Further, the piston 58 is biased by a conventional biasing member, such as spring 59, towards a lower position in chamber 64. Subchamber 63' contains a temperature sensitive gas, i.e., a gas whose volume is extremely dependent upon its temperature, such as sulfur dioxide. A thin, semi-flexible tube 68 connects the interior of subchamber 63' to a bulb 66 (FIGS. 1 and 2) preferably mounted in compartment 20. The bulb 66 and connecting tubing 68 are filled with the same gas as subchamber 63' so that if the bulb 66 experiences a change of temperature the volume of the gas contained within it will correspondingly change thereby changing the pressure applied to piston 58. The system may be adapted so that with the temperature in the refrigerator compartment above a certain predetermined value, the gas within the bulb 66 and cylinder portion 63' will have greater volume than normal and thereby force piston 58 upwardly against the force of spring 59. The rod 56 moves upwardly with piston 58 whereupon its upper end depresses pin 60 thereby opening valve 62 which allows the liquid refrigerant to pass through valve 62 into the interior of sleeve 52. Capillary tube 34 fluidly communicates with sleeve 52 through a fitting 65 provided on the end of a branch of sleeve 52 and the liquid refrigerant exits sleeve 52 and enters capillary tubing 34. In order to assure that none of the refrigerant inadvertently escapes from the thermostatically controlled valve 32, a diaphragm 72 having its periphery sealed to an upper plate 74 and its central portion fixed via a pair of sealing rings 76 to rod 56 confines the refrigerant within sleeve 52.

At the beginning of operation, at room temperature, the temperature-sensitive gas is in its expanded state and, accordingly, pin 60 is depressed opening valve 62 allowing the refrigerant to flow into capillary tubing 34 wherein its pressure is reduced. The refrigerant flows into primary evaporator 30 where it is at least partially evaporated thereby cooling the refrigerator compartment. As the temperature within the refrigerator compartment descends toward the predetermined value, the gas in bulb 66 contracts thereby allowing piston 58 to move downwardly under the force of spring 59. Thus, pin 60 begins to return to its normal, protruding configuration until the valve 62 is closed (when the predetermined temperature is reached in the refrigerator compartment).

Figure 4:
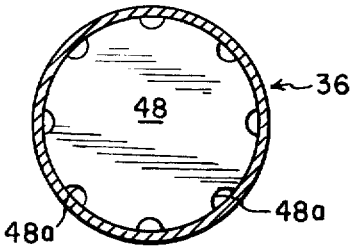
FIG. 4 is a section view taken along 4—4 of FIG. 3.

As mentioned above, it is not uncommon for the refrigerant to evaporate only partially in the primary evaporator. This may be due to insufficient pressure reduction in capillary tube 34 or the temperature conditions within refrigeration compartment 20. The mixed-phase refrigerant then produced is directed from the primary evaporator to the phase separation tank 36 through a tube entering through port 37. Referring to FIG. 3, where the phase separation tank 36 is shown in section, the tank comprises a cylindrical container having a series of baffles 46 (four shown by way of illustration) each mounted at an angle to the horizontal, and horizontally mounted upper and lower baffles 48, 50 respectively. Upper baffle 48 (FIG. 4) preferably is formed with a series of spaced notches **48*a* around its periphery while lower baffle 50 includes a single opening $\mathbf{50}_Z$ formed in its center. Each of the angularly mounted baffles 46 has a single opening 46*a* formed through its lower portion. In operation, the refrigerant enters the tank through a port 37 from the primary evaporator, settling in the lowermost chamber of tank 36 defined by baffle 50 and the bottom of the tank. As noted above, the refrigerant entering tank 36 through entrance 37 is often in mixed phase, i.e., predominantly gaseous but with some liquid refrigerant remaining. The gaseous phase passes through the apertures 50, 46*a*, and 48*a* formed in the baffles and finally exits into the atmosphere through a tube 38' emanating from port 38** provided at the upper end of the tank.

The liquid phase, however, is prevented from progressing to the point where its exit through vent 38 is possible. As mentioned above, should the liquid refrigerant escape from the system and come into contact with the skin, severe "freeze burns" may occur. The particular construction of the baffle system in the tank assures that no liquid refrigerant will be carried out through port 38 along with the gaseous phase. More particularly, most of droplets of liquid which are carried upwardly will merely run into the lower surface of baffle 50. Should any liquid get past baffle 50 through aperture **50*a*, it will certainly eventually be deposited on the underside of one of the baffles 46 and run down the same towards the lower end of tank 36. In this manner, the liquid refrigerant is accumulated with tank 36** and prevented from exiting into the atmosphere.

The bottom of tank 36 is conical in shape and has an opening 40 formed at its apex which serves as a liquid refrigerant outlet from the tank. Outlet 40 is fluidly connected via tube 40' to a secondary evaporator 42 located below primary evaporator 30 within the refrigerant compartment 20. Thus, the residual liquid refrigerant exits from the tank through outlet 40 due to gravity aided by the pressure differential mentioned hereinabove and flows into the secondary evaporator 42 where it evaporates. The outlet end of secondary evaporator 42 communicates with tank 36 via tube 44' which is connected to tank inlet 44. The completely evaporated residual refrigerant is vented through apertures 50*a*, 46*a* and 48*a* in the baffles and finally to the atmosphere through port 38.

The phase separation tank in combination with the secondary evaporator results in a much more efficient unit than was heretofore possible. As mentioned above, there is no residual unevaporated refrigerant remaining in the system. It has been found that in a system wherein 3 feet of 1/32 inch capillary tubing is used with the primary and secondary evaporators being 4 and 2 feet long of ¼ inch copper tubing respectively and all other fluid conducting tubing being ¼ inch copper tubing, if the refrigerator compartment of the chest is maintained at about 45°F., in a manner described below, evaporation of the refrigerant is complete in the primary evaporator. However, should the temperature of the refrigerator compartment be kept at about 32°F, approximately one-fifth of the volume of a 7-inch high separation tank having a diameter of about 3 inches will become filled with residual liquid refrigerant which is then cycled back to the secondary evaporator. This accumulated residual refrigerant is completely evaporated in the secondary evaporator and directed to tank 36 where it is vented.

The particular temperature at which the refirgerator chamber 20 of the chest is maintained is determinable in several ways. For example, the particular temperature sensitive gas used in the bulb 66 and subchamber 65 may be changed so that a change of temperature within the refrigerator chest will cause selectively more or less movement of rod 56 which in turn will either accelerate and decelerate the opening valve 62 in response to the change of temperature. Another more convenient method of varying the temperature within the chest is to merely replace the cylinder and piston unit 58, 64, 59 with one whose spring has a stiffness which will give the desired results. For example, if the unit is replaced with one having a stiffer spring 59, a decrease in temperature will allow the piston 58 and rod 56 to move downward to a greater degree thereby closing valve 62 faster than it would otherwise be closed, thereby maintaining a temperature at a higher point. Still another alternative is the provision of an adjustable spring in lieu of spring 59. By adjustable spring is meant a spring whose constant may be varied such as by rotating one end to increase the number of coils or by compressing the spring longitudinally.

Figure 5:
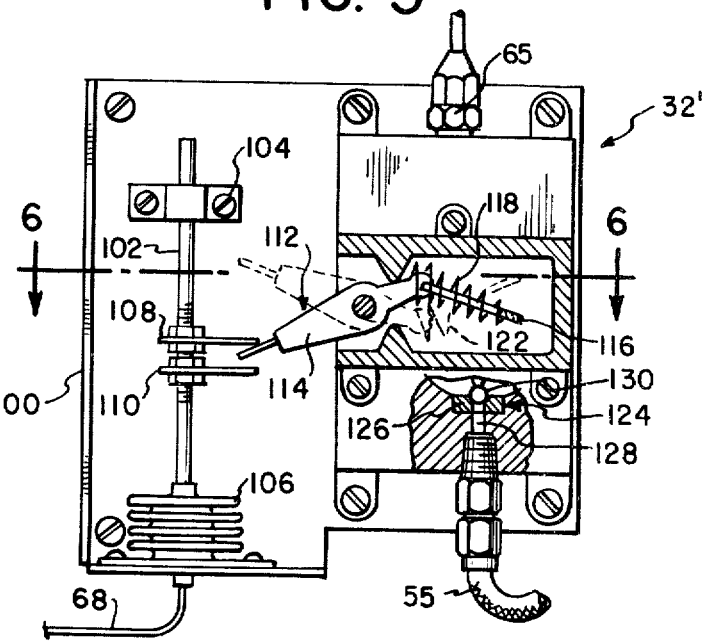
FIG. 5 is a front view in partial section of an alternate embodiment of a thermostatic control valve for use with the present invention.
Figure 6:
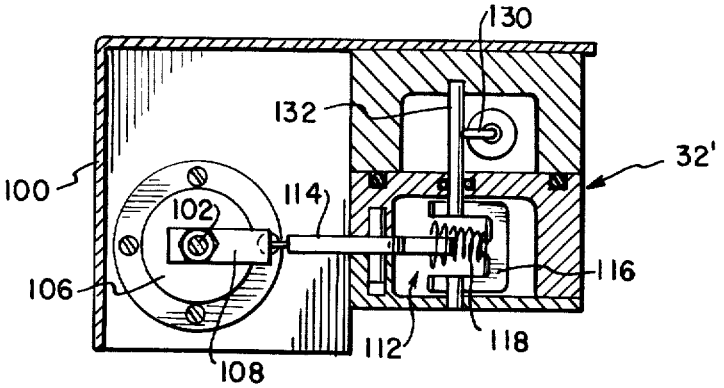
FIG. 6 is a section view taken along line 6—6 of FIG. 5.

Another embodiment of the thermostatic control valve is shown in FIGS. 5 and 6. Referring to these figures, a thermostatic control valve, generally denoted as 32', comprises a housing 100 in which a rod 102 is slidably mounted by bracket 104. The lower end of rod 102 is fixed to bellows 106 whose interior communicates with tubing 68 and bulb 66 in a manner similar to the previously discussed embodiment. Thus, as the temperature in the refrigerator compartment increases and the gas within bulb 66, tube 68 and bellows 106 expands, bellows 106 expands and rod 102 is caused to move upwardly. The mid-portion of rod 102 is threaded and upper and lower fingers 108, 110 respectively are mounted on rod 102 for movement with it.

A toggle or off-center mechanism 112 comprising an arm 114 pivoted to housing 100 having an end extending between upper and lower fingers 108, 110 and a U-shaped member 116 also pivoted to housing 100 and connected to the arm 114 by a spring 118 is actuated between one of two positions by the movement of rod 102. More particularly, if rod 102 is caused to move upwardly to a position indicated by 120 (FIG. 5), the lower finger 110 will pivot arm 114 until the toggle mechanism 112 passes through its off-center point at which time it will snap into the position indicated by 122 (FIG. 5). Thus, the toggle mechanism will be in either one of two positions depending upon the temperature within the refrigeration compartment.

Displaced behing toggle mechanism 112 as seen in FIG. 5 is a check valve 124 comprising a ball 126 normally biased against the mouth of a passage 128 thereby preventing the flow of refrigerant from flexible conduit 55 to the capillary tube 34 through fitting 65. The ball 126 is maintained in its closed position as seen in FIG. 5 by the end of a rod 130, whose other end is connected to a shaft 132 which extends along the axis of rotation of U-shaped member 116. When rod 102 moves to position 120 due to an increase in temperature in the refrigerator compartment, the toggle switch is repositioned to position 122, rotating shaft 132, opening valve 124 thereby allowing more refrigerant to flow. When sufficient refrigerant has evaporated, to cool the refrigerator chamber, bellows 106 contracts, moving rod 102 downwardly, actuating the toggle mechanism to be positioned as shown in FIG. 5, which causes check valve 124 to close. It is seen that the temperature at which the toggle mechanism is actuated may be varied by merely repositioning fingers 108, 110 on rod 102.

Figure 7:
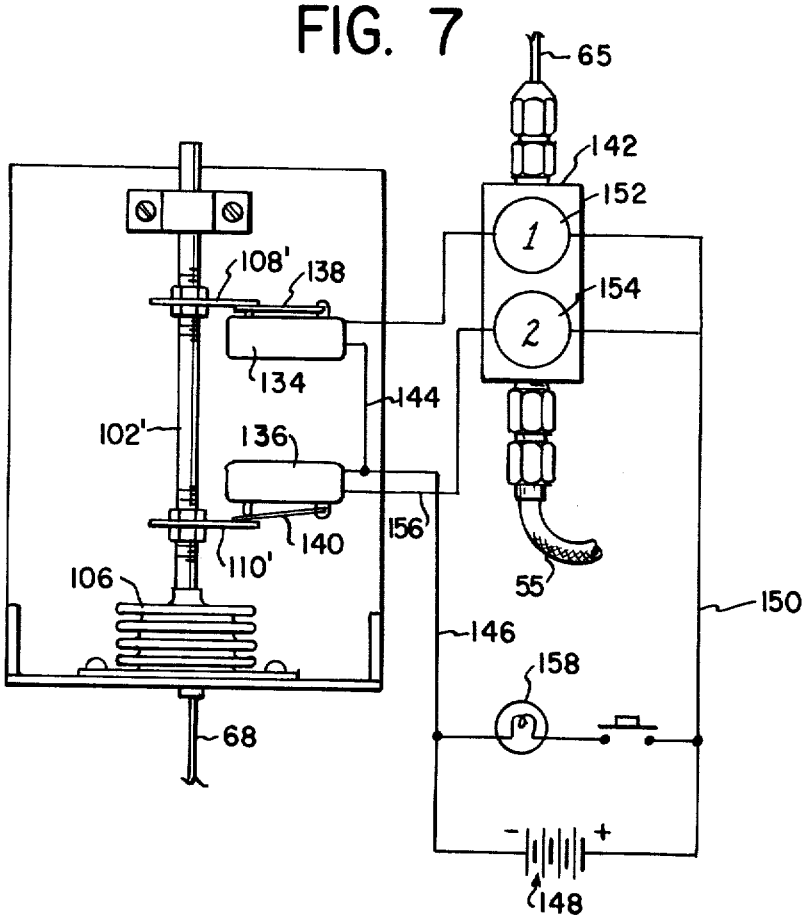
FIG. 7 is a schematic view of still another alternate embodiment of a thermostatic control valve for use with the present invention.

Referring to FIG. 7, still another embodiment 32'' of a thermostatic control valve is illustrated. In this embodiment a rod 102' is slidably moved similarly to rod 102. Upper and lower fingers 108', 110' are adjustably positioned on rod 102', such as by threaded engagement. Microswitches 134, 136 having their actuating arms 138, 140 respectively, contiguous with fingers 108', 110' and are so positioned that one and only one of the two microswitches are closed at one time. Each microswotch controls a solenoid provided in a conventional solenoid actuated switch 142. More particularly, when microswitch 134 is closed as shown in FIG. 7, a circuit comprising conductors 144, 146, power sources 148, conductor 150 and solenoid 152 is closed, actuating solenoid 152 to close switch 142 in a conventional manner. As the temperature in the refrigerator compartment increases, rod 102' moves, closing microswitch 136 and opening microswitch 134. This completes the circuit comprising conductor 146, power source 148, conductor 150, a solenoid 154 and a conductor 156 thereby actuating solenoid 154 to open switch 142 in a conventional manner to allow more refrigerant to flow. Again, the particular temperature at which the microswitches are actuated may be controlled by varying the position of fingers 108', 110' on rod 102'. A test light 158 may be provided to check the power source 148.

Obviously, numerous variations and modifications of the present invention are possible in light of the above teachings. It is therefore to be understood that within the scope of the appended claims the invention may be practices otherwise than as specifically described herein. For example, any conventional expansion device such as an expansion valve may be used in lieu of capillary tube 34. Further, other configuration of the phase separator tank may be employed in the practice of the invention.

What is claimed is:

1. A portable unit including a compartment adapted to be used for refrigeration comprising:

a primary evaporator located within the compartment having an inlet and an outlet, said primary evaporator adapted to receive liquid refrigerant which at least partially evaporates therein and thereby withdraws heat from and cools the compartment;

conduit means including pressure reducing means, having one end connected to the inlet of said primary evaporator, the other end being connectable to a source of pressurized liquid refrigerant;

a secondary evaporator located within the same said compartment having an inlet and an outlet, said secondary evaporator adapted to receive liquid refrigerant which evaporates therein and thereby cools said compartment; and phase separator means fluidly communicating with the outlet of said primary evaporator for receiving said at least partially evaporated refrigerant and venting the gaseous phase thereof to the atmosphere and fluidly communicating with the inlet of said secondary evaporator for directing the liquid phase of the refrigerant to the secondary evaporator.

2. A portable unit as recited in claim 1 wherein said phase separator means includes a substantially enclosed tank having an inlet formed adjacent its lower end for receiving refrigerant from said primary evaporator, a liquid refrigerant outlet formed at its lower end for directing liquid refrigerant to said secondary evaporator and a gas vent formed on the upper end of said tank for said gaseous refrigerant.

3. A portable unit as recited in claim 3 wherein said tank has at least one baffle provided with its interior dividing said interior into separate chambers, said baffle having apertures formed therethrough for passage of said gaseous refrigerant therethrough.

4. A portable unit as recited in claim 1 further including a thermostatic control device interposed in said conduit means for selectively obstructing the flow of said refrigerant through said conduit means in response to a predetermined temperature within said compartment and a temperature-responsive device associated with said thermostatic device for sensing the temperature within said compartment.

5. A portable unit as recited in claim 4 wherein said thermostatic control means includes a normally closed valve and a rod having one end fixed to a movably mounted piston and the other end operably associated with said normally closed valve adapted to open said valve upon the movement of said piston.

6. A portable unit as recited in claim 3 wherein said piston is mounted in a gas tight cylinder and said temperature sensing means includes a bulb located within said refrigeration compartment containing a temperature sensitive gas, said bulb and cylinder being connected by a gas conduit so that when the temperature in said compartment is greater than said predetermined value, said temperature sensitive gas is in an expanded state which causes said piston and rod to move opening said normally closed valve and when the temperature is below said predetermined value, said gas is in a contracted state and said valve is closed.

7. A portable unit as recited in claim 4 wherein said thermostatic control means includes a slidably mounted rod having one end fixed to an expandable chamber, a pair of fingers extending from said rod movable therewith a toggle means coupled to said fingers, positionable in one of two positions and a valve adapted to open and close depending upon the position of said toggle means.

8. A portable unit as recited in claim 4 wherein said thermostatic control means comprises a slidably mounted rod having one end fixed to an expandable chamber, at least one finger extending from said rod movable therewith, a microswitch adapted to be opened or closed depending on the position of said finger, a solenoid actuated valve, and circuit means including said microswitch for opening and closing said solenoid actuated switch.

* * * * *